US006516901B1

(12) United States Patent
Falgout, Sr.

(10) Patent No.: US 6,516,901 B1
(45) Date of Patent: Feb. 11, 2003

(54) ADJUSTABLE ORIENTING SUB

(76) Inventor: Thomas E. Falgout, Sr., 110 Charles Read St., Lafayette, LA (US) 70503

( * ) Notice: Subject to any disclaimer, the term of this patent is extended or adjusted under 35 U.S.C. 154(b) by 0 days.

(21) Appl. No.: 10/114,777

(22) Filed: Apr. 1, 2002

(51) Int. Cl.[7] ..... E21B 7/10

(52) U.S. Cl. ..... 175/74; 175/256; 175/320; 285/333

(58) Field of Search ..... 175/73–75, 256, 175/320; 285/333, 118, 36

(56) References Cited

U.S. PATENT DOCUMENTS

| | | | | |
|---|---|---|---|---|
| 4,303,135 A | * | 12/1981 | Benoit | 175/73 |
| 4,836,305 A | * | 6/1989 | Curlett | 175/215 |
| 5,050,691 A | * | 9/1991 | Moses | 175/57 |
| 5,168,943 A | | 12/1992 | Falgout, Sr. | |
| 5,269,385 A | * | 12/1993 | Sihlis | 175/74 |
| 5,479,995 A | | 1/1996 | Falgout, Sr. | |
| 5,785,357 A | * | 7/1998 | Foster et al. | 285/92 |

FOREIGN PATENT DOCUMENTS

DE 3223112 A1 * 12/1983

* cited by examiner

*Primary Examiner*—David Bagnell
*Assistant Examiner*—Zakiya Walker
(74) *Attorney, Agent, or Firm*—John D. Jeter

(57) ABSTRACT

Opposite ends, or terminals, of the sub are connected by a tubular arbor with threaded pins on each end. The arbor is bent in the middle. A mating threaded box on the upper terminal is tilted an amount equal to the bend angle of the arbor and mates with the bent end of the arbor. If the arbor is rotated in the box, the centerline of the other threaded end describes a cone. One line on the cone is the axis of rotation of the upper terminal. If the lower terminal is locked in that position, the sub is in the straight configuration. Locked in any other rotational position, the sub is bent an angle that is a function of the amount of arbor rotation. To make the arbor adjustable from the outside, an indicator ring is mounted on splines on the arbor. The ring can slide axially on the arbor. The lower terminal can be tightened on the lower end of the arbor to jam the indicator against the upper arbor, locking the assembly for use. At least one pin is provided to reside in aligned holes in the mating faces of the upper terminal and the indicator ring.

15 Claims, 4 Drawing Sheets

ADJUSTABLE ORIENTING SUB

RELATED PATENTS

This invention is an improvement on the U.S. Pat. No. 5,479,995, issued on Jan. 2, 1996, to the inventor of the present application. The improvement pertains, mostly, to means to control the adjustments in the field and to lock the related apparatus against loosening when in use down hole. An earlier version of the patent referenced above was U.S. Pat. No. 5,168,943, issued Dec. 8, 1992 to the inventor of the present application.

This invention pertains to orienting apparatus normally used down hole during directional drilling activities. Adjustments include relative rotation of opposite ends of the sub or, in an alternate configuration, includes changes in the bend angle of the sub.

BACKGROUND OF INVENTION

When drilling directional wells or maintaining direction and angle of progressing drilling of earth bore holes it is often necessary to introduce bends in the drill string. The bends are usually near the drill head. Sometimes, the bends are within drilling motor bodies. Apparatus of the patents cited above are examples of contrivances installed in drill string components to accomplish the needed bend, or rotational relationship of opposite ends of the related drill string.

The tools related to the cited patents have some features that invite errors when making changes in the field to adjust the deflection or orientation angles. The tools are calibrated at the factory and scribed to indicate the amount of deflection angle to be achieved when adjusted later in the field. Problems arise when the indicator ring itself is removed from a spline retained relationship with a major component that is essential to adjustment but is not visible from outside the assembled tool. The details of construction presented later herein will clarify that relationship and the means to prevent loss of calibration in the field, during adjustments.

SUMMARY OF THE INVENTION

There are three major functional components, an arbor, or generally central tubular member, with male threads on each end and a generally tubular mating box terminal on each end. The threads on one end of the arbor, and their mating box threads, differ in pitch from the threads on the opposite end.

The threaded boxes are run onto the related mating pin end until both box faces abut a spacer ring between the two. The spacer ring, defined herein as an indicator ring, is free to slide axially but it is rotationally connected to the arbor by splines. If the box with the finer thread is backed away from the indicator ring by a specific rotational amount, the coarser thread of the opposite box requires less rotational adjustment to again abut the spacer ring. Consequently, the opposite ends of the tool will then have a changed rotational relationship. Change in the rotational relationship, in one configuration, changes the bend angle within the sub. Change in the rotational relationship, in the other configuration, changes the rotational relationship of opposite ends of the sub.

If the tool is used only for changing the rotational relationships of the opposite ends of the tool, the adjustment just described changes the drill head related tool face relative to the drill string above the tool.

If the tool is used to adjust the bend angle of the drill string, within the tool, the box threaded terminal ends will have a deflection angle built in. The female threads of the box is symmetrical about one centerline and the continuing end of that terminal has a centerline that crosses the thread related centerline at a selected angle, often at about two degrees. When the tool is shop calibrated, the zero deflection relationship is established such that all center lines lie in the same plane, but the extending ends depart the thread center line in opposite directions. There is a minor jog in the general centerline but the continuing center lines are parallel. There is, then, no deflection angle in the overall assembly. The small jog is without effect.

To adjust the tool to a specified angle, one end is loosened from the abutting situation, and the opposite end is run onto the arbor until the abutting relationship is re-established. The tool then has a deflection angle that depends upon the amount of rotation given to the first end loosened. That amount of deflection is then scribed upon the ring separating the abutting faces of the box threaded terminal ends. The actual manipulation differs somewhat from this simplified description to clarify basic functions. Details that enable the use of the locking pin P will follow herein.

The tool, as presently improved, simplifies the adjustment by providing an indexing pin protruding from the abutting face of a first terminal end. The calibrating ring then has a series of holes that can accept the pin. The series of holes are peripherally spaced such that each hole will correspond with an amount of rotation of the arbor within the first terminal end that will yield a selected deflection when the assembled tool is torqued together for use. The manipulation is the same for the version of the tool that adjusts only the rotational relationship of opposite ends of the sub.

The ring can be moved axially on the arbor, along the connecting splines to allow the ring to rotate clear of the protruding pin after the second box is backed away from the indicator ring. The indicator ring is then rotated, to rotate the spline connected arbor within the first end box threads. With the chosen rotation accomplished, the ring slides along the spline to abut the face of the first end, with the pin sliding into the prepared hole in the ring abutting face. The second box end is then run into abutment, tightened and locked in place with screws that extend radially through the box wall to engage the arbor. The adjustment is complete.

The pin accepting holes in the ring correspond with a scribe line visible on the outer surface of the ring. The deflection angle achieved by the adjustment has a corresponding number stamped at the scribe line. The orienting version of the sub has similar markings on the ring relative to rotational changes of opposite ends of the sub.

Retaining rings on the arbor are situated such that the ring can move an amount needed for field adjustment but the ring will not lose the splined relationship with the arbor established during shop calibration. When used in the field, the abutting faces wear or distort, in time. The retaining ring can be removed in the shop and the indicator ring can be moved axially to clear the splines and can be rotationally repositioned on the arbor to restore calibration accuracy. The loss of calibration is a slow process and is detected when being dresses in the shop for return to the field.

The documentation supplied with the tool indicates the angular situation of the tool in light of the numbers stamped on the indicator ring that coincides with a scribe line on the box of the first end.

These and other objects, advantages, and features of this invention will be apparent to those skilled in the art from a consideration of this specification, including the attached claims and appended claims.

DETAILED DESCRIPTION OF DRAWINGS

Figure 1:
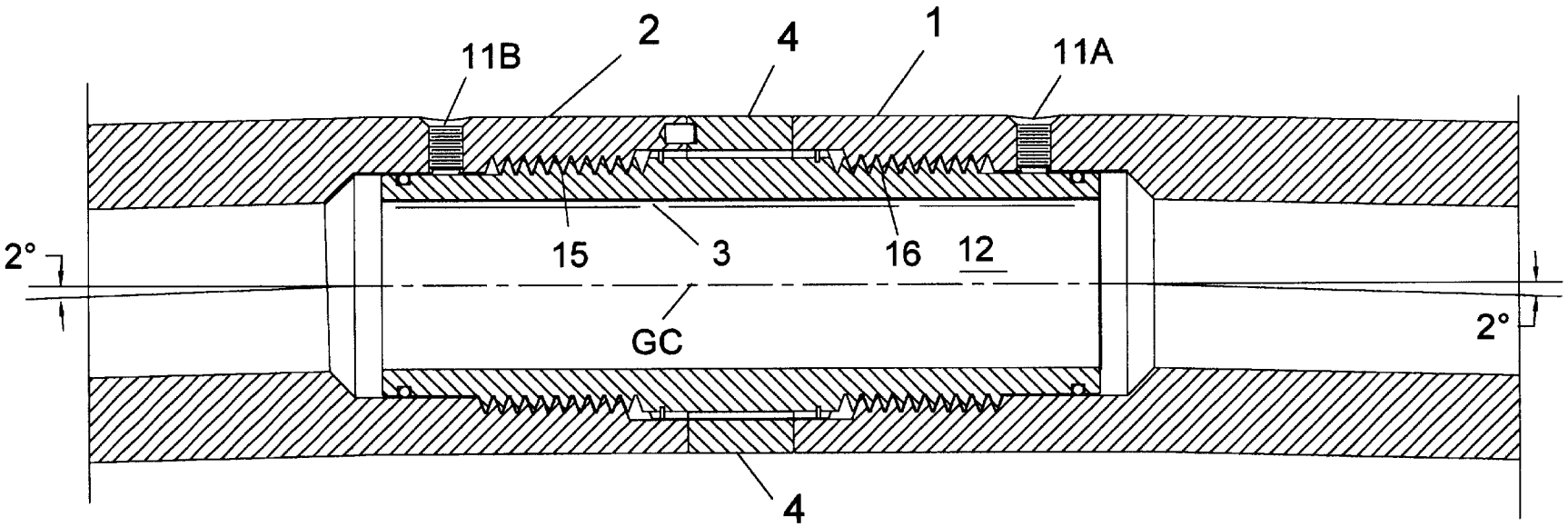
FIG. 1 is a side view, in cut-away, of the preferred embodiment showing the overall assembly with continuing drill string elements.

FIG. 1 represents the deflection form of the tool in the maximum deflected condition. Terminals 1 and 2 have female box threads 16 and 15 respectively that are on the same center line as the general arbor 3 center line GC. The bore of each terminal deflects, in this case two degrees each, at the end of each box. The total deflection is four degrees. This tool can be set to deflect in twelve increments, in this case, of smaller deflections up to four degrees. Details of the adjustment and related locking arrangement is deferred to larger scale drawings.

Bore 12 can accept the drive shaft of a down hole drilling motor. Such arrangements are presented in the referenced patents, and in FIG. 2 herein. The faces of the boxes abut the mating faces of the indicator ring 4. When the tool is made threadedly tight, or torqued up, and excepting the bore 12, the tool has the density near that of solid steel. It is a rigid assembly.

Figure 2:
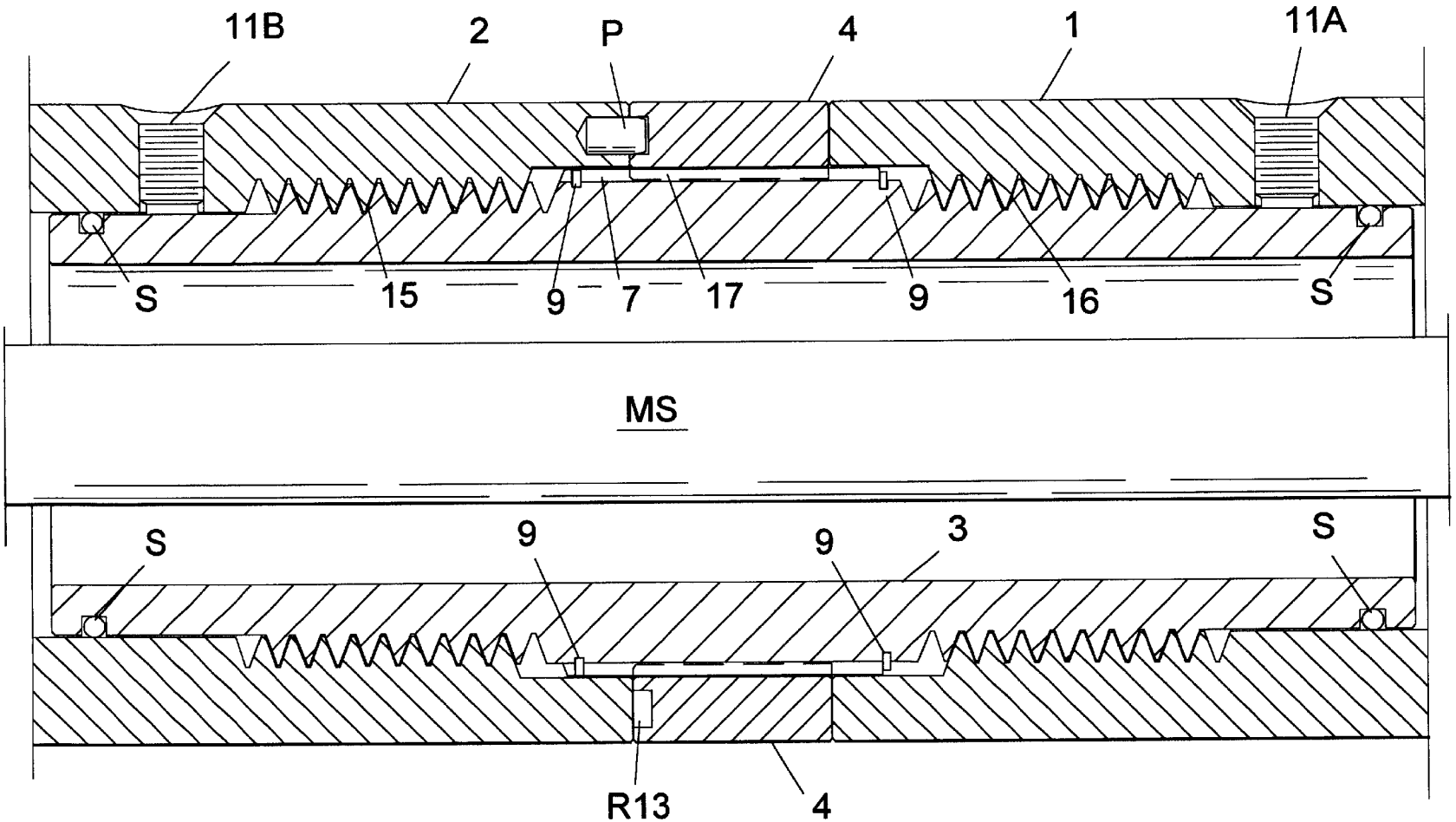
FIG. 2 is a side view, somewhat enlarged and in cut-away, of the active element assembly which is a selected portion of FIG. 1.

FIG. 2 is the same as FIG. 1, showing only active elements involved in adjustments. Terminal end 2 has one hole for pin P. The indicator ring 4 has thirteen holes, in this case, distributed peripherally about the face of ring 4. To move ring 4, terminal 1 is first loosened to clear the pin from the hole in ring 4. Ring 4 can then be slid rightwardly on the mating splines 7 and 17. Ring 4 can be turned a desired amount, and rotates arbor 3 in the process. Mating threads 15 are fine pitch threads. When the desired amount of turn is achieved, a scribe line on terminal 2 will align with the desired scribe line on ring 4 (see FIG. 7). The ring is then slid leftward and pin P will enter the aligned bore in ring 4. When terminal 1 is turned to bring the box and ring faces into abutment it will turn less then the rotational amount arbor 3 turned, as described, because threads 16 are coarse threads. All threads are right hand lay and drilling action will keep the threads tight. Set screws 11A, there are three screws distributed equally around the periphery of terminal 1. A motor shaft MS is shown, in the case it is used within a drilling motor body. Set screws 11B are redundant security between arbor 3 and terminal 2, and they add a stiffening effect to the tool.

Lock rings 9 prevent removal of ring 4 from the splines that rotationally secure ring 4 to arbor 3. The ring should not be removed in the field. If the faces of the boxes or ring are reworked in the shop the indicator ring is axially removed from the arbor splines and rotated relative to the arbor to calibrate the tool in the straight position so that the incremental scribe lines, see FIG. 8, still have the intended effect. No scribe line is needed on the box of terminal 1 because torqueing up the tool establishes the intended relationships between all three major elements.

Seals S seal the fluid into bore 12 and prevent leakage at the set screws, and at the abutting faces if needed. Bore R13 is diametrically opposite the bore accepting pin P. If the pin P, as shown, is in bore R1, the tool is in the straight configuration. If the pin P is in bore 13, the tool will be in the maximum deflection, or four degrees in this case.

Figure 3:
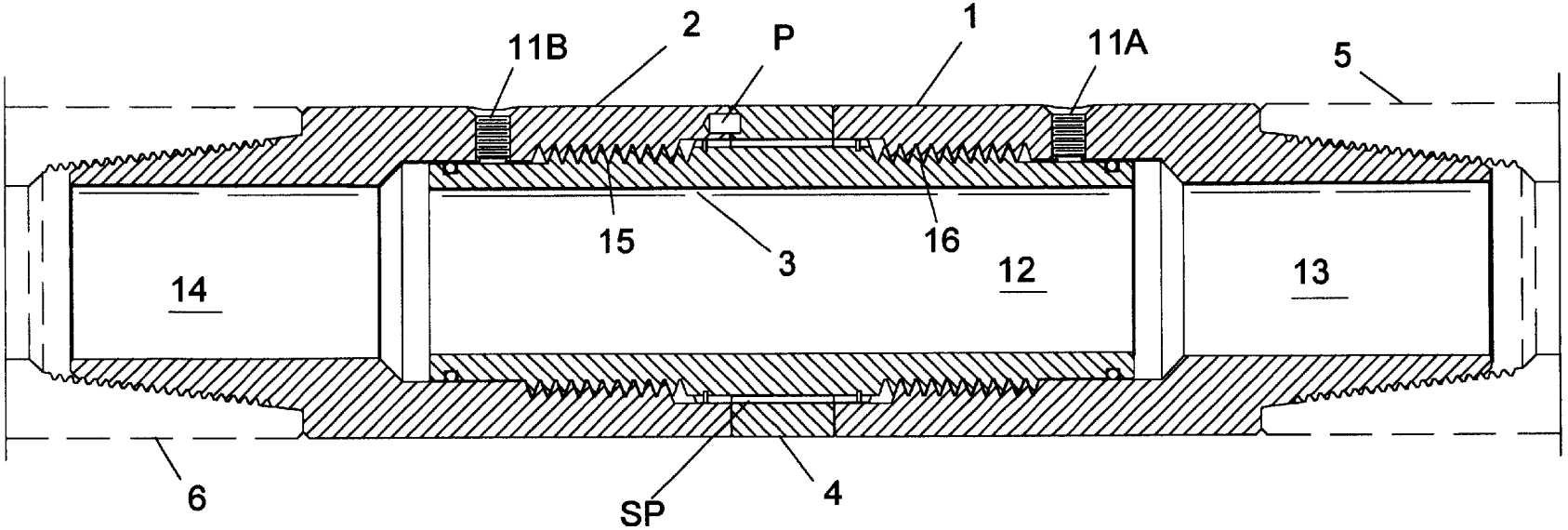
FIG. 3 is a side view, in cut away of the preferred embodiment with stub ends for attachment to continuing drill string elements.

FIG. 3 is essentially the same tool as FIG. 2 but the terminals are the short versions commonly used above drilling motors. Elements 5 and 6 are common drill string elements, with specified tool joint connections. The spline arrangement on ring 4 and arbor 3 are captioned SP. An orienting version of the tool is shown and bores 13 and 14 are not deflected. Adjustment of this tool rotates the lower end of the drill string relative to the upwardly continuing drill string. This tool normally corrects the drill head tool face relative to directional drilling instruments above this tool. The tool of FIG. 2 is often used below this tool and achieves deflection adjustment at the expense of loss of the original upper and lower scribe line relationships. In other words one tool can correct the possible rotational errors produced by the other.

Figure 4:
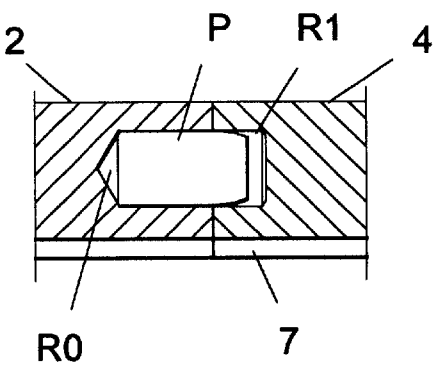
FIG. 4 is a side view, a section of a portion of the assembly such as FIG. 1, showing the rotational locking together of two elements of FIGS. 1–3.

FIG. 4 is an enlarged area of the tool including pin P which normally resides in hole RO of terminal 2.

Figure 5:
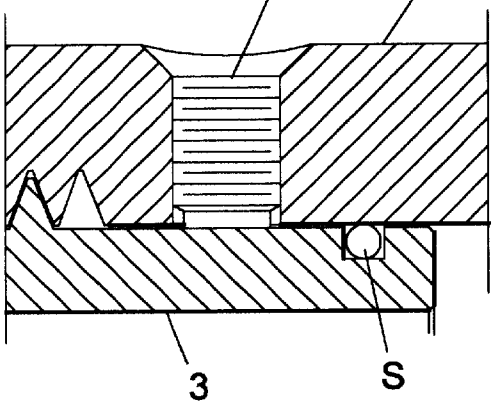
FIG. 5 is a section of a selected area of FIGS. 1–3.

FIG. 5 is an enlarged area showing set screw 11A in terminal 1. Seal S is shown in O-ring configuration but different seal configurations serve better, and are used, in some applications.

Figure 8:
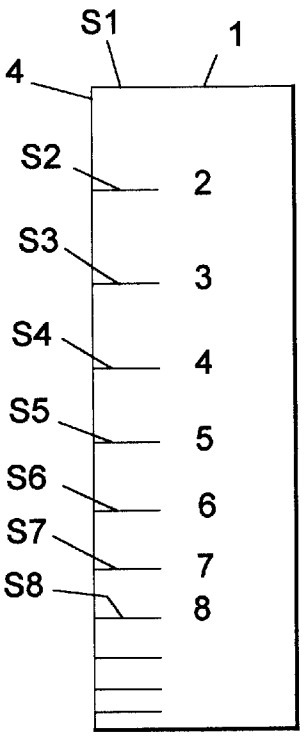
FIG. 8 is a side view, from line 8—8 of FIG. 7 showing the relationship between scribe lines visible from outside the assembled tool and the locking holes that are not visible from outside the assembled tool.
Figure 7:
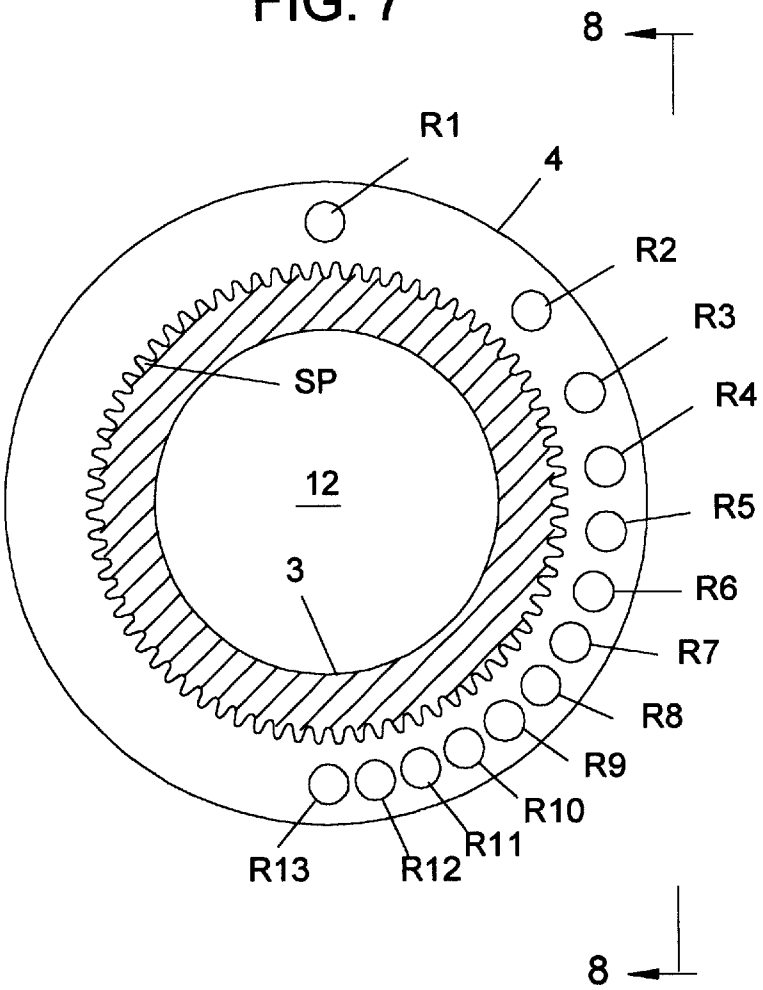
FIG. 7 is a sectional view taken along line 7—7 of FIG. 6.
Figure 6:
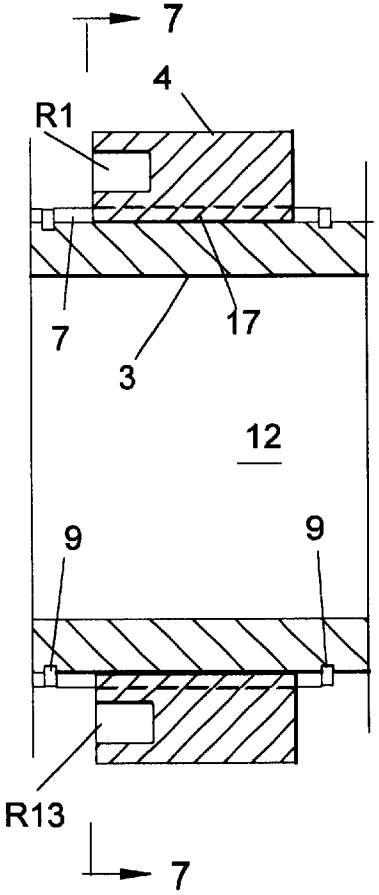
FIG. 6 is a sectional view cut along the assembly center line showing the splined relationship between the calibrating ring and the arbor it controls rotationally. The terminal ends are removed.

FIGS. 6, 7, and 8 show indicator ring details. Note that the male and female spline arrangement SP is the same as male splines 7 and female splines 17. A single spline step usually corrects changes in tool calibration. Scribe lines such as S3 usually correspond to the position of bore R3. When the tool is sent to the field, it is accompanied by a graphic display of the deflection angles accomplished by the calibrated settings. When the tool is set at deflection 3, for instance, the scribe line 3 is aligned with an index scribe line on terminal 2.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. An improved adjustable orieting sub for use as a length element of drill string to adjustably change the relative orientation between drill string portions axially separated by the sub, the sub comprising:

a) a generally central tubular member, with an axis, with independent male threads on each end, one said end having coarser pitch threads and the other end having finer pitch threads, and a generally central portion with splines on the outer surface;

b) a first generally tubular terminal end, with means on one end to attach to a continuing drill string and coarser pitch box threads on the other end to mate with the coarser pitch male threads;

c) a second generally tubular terminal end, with means on one end to attach to a continuing drill string, and finer pitch box threads on the other end to mate with the finer pitch male threads;

d) a generally central indicator ring with opposite planar faces to separate the faces on the boxes of the first and second terminal ends, with an internal spline arrangement to rotationally engage the splines on the outer surface of the generally central tubular member and to slide axially some distance thereon, with a plurality of peripherally distributed holes, equally spaced radially, from the axis, opening on one face of the ring; and e) a locking pin protruding from the face of one box end axially situated to enter any one of the peripherally distributed holes.

2. The sub of claim 1 wherein at least one lock ring is situated on said generally central tubular member arranged to prevent removal of said indicator ring from rotational engagement with said splines thereon.

3. The sub of claim 1 wherein said first and said second terminal ends have axially extending centerlines deflected at a selected angle from said axis.

4. The sub of claim 1 wherein threads of said coarser pitch threads are double threads.

5. The sub of claim 1 wherein said locking pin is removably situated in a hole in the box face of the associated terminal end.

6. The sub of claim 1 wherein axially extending scribe lines on the outer surface of the indicator ring are situated to correspond to each of the holes.

7. The sub of claim 6 wherein each of said scribe lines has a symbol related to the amount of adjustment in the relationship between opposite ends of the sub.

8. The sub of claim 1 wherein at least one of said terminal ends is provided with at least one set screw situated in a radially extending tapped hole, situated to engage said generally central tubular member to prevent relative rotation therebetween, the tapped hole opening on the outside surface of the terminal end.

9. An improved adjustable orienting sub for use as a length element of drill string to adjustably change the relative orientation between drill string portions axially separated by the sub, the sub comprising:

a) a generally central tubular member, with an axis, with independent male threads on each end, one said end having coarser pitch threads and the other end having finer pitch threads, and a generally central portion with splines on the outer surface;

b) a first generally tubular terminal end, with means on one end to attach to a continuing drill string and coarser pitch box threads on the other end to mate with the coarser pitch male threads, having a centerline that is bent between the means to attach to continuing drill string and the box threads;

c) a second generally tubular terminal end, with means on one end to attach to a continuing drill string, and finer pitch box threads on the other end to mate with the finer pitch male threads, having a centerline that is bent between the means to attach to continuing drill string and the box threads;

d) a generally central indicator ring with opposite planar faces to separate the faces on the boxes of the first and second terminal ends, with an internal spline arrangement to rotationally engage the splines on the outer surface of the generally central tubular member and to slide axially some distance thereon, with a plurality of peripherally distributed holes, equally spaced radially, from the axis, opening on one face of the ring; and e) a locking pin protruding from the face of one box end axially situated to enter any one of the peripherally distributed holes.

10. The sub of claim 9 wherein at least one lock ring is situated on said generally central tubular member arranged to prevent removal of said indicator ring from rotational engagement with said splines thereon.

11. The sub of claim 9 wherein threads of said coarser pitch threads are double threads.

12. The sub of claim 9 wherein said locking pin is removably situated in a hole in the box face of the associated terminal end.

13. The sub of claim 9 wherein axially extending scribe lines on the outer surface of the indicator ring are situated to correspond to each of the holes.

14. The sub of claim 13 wherein each of said scribe lines has a symbol related to the amount of adjustment in the relationship between opposite ends of the sub.

15. The sub of claim 9 wherein at least one of said terminal ends is provided with at least one set screw situated in a radially extending tapped hole, situated to engage said generally central tubular member to prevent relative rotation therebetween, the tapped hole opening on the outside surface of the terminal end.

* * * * *